US006397652B1

(12) United States Patent
Sollami

(10) Patent No.: US 6,397,652 B1
(45) Date of Patent: Jun. 4, 2002

(54) TOOL BODY AND METHOD OF MANUFACTURE

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 09/532,994

(22) Filed: Mar. 22, 2000

(51) Int. Cl.[7] ..... B21D 22/00

(52) U.S. Cl. ..... 72/360; 72/353.2; 72/357; 72/377

(58) Field of Search ..... 72/353.2, 354.2, 72/354.6, 354.8, 357, 358, 359, 360, 377

(56) References Cited

U.S. PATENT DOCUMENTS

| | | | | | |
|---|---|---|---|---|---|
| 774,810 | A | | 11/1904 | Willis | |
| 1,568,031 | A | | 12/1925 | Wilcox | |
| 3,036,366 | A | | 5/1962 | Richs | |
| 3,189,993 | A | | 6/1965 | Whitted | |
| 3,507,140 | A | | 4/1970 | Tassaro | |
| 3,566,664 | A | * | 3/1971 | Schweizer | 72/357 |
| 3,648,509 | A | | 3/1972 | McDowell | |
| 4,078,415 | A | | 3/1978 | Kock et al. | |
| 4,177,665 | A | | 12/1979 | Schurmann | |
| 4,413,496 | A | * | 11/1983 | Diemer et al. | 72/358 |
| 4,452,063 | A | | 6/1984 | Sebastiani et al. | |
| 4,512,175 | A | | 4/1985 | Kaku et al. | |
| 4,607,514 | A | | 8/1986 | Nippert | |
| 4,838,062 | A | * | 6/1989 | Prenn | 72/357 |
| 5,090,611 | A | * | 2/1992 | Takikawa et al. | 72/357 |
| 5,795,234 | A | * | 8/1998 | Inada et al. | 470/16 |

FOREIGN PATENT DOCUMENTS

| | | | | |
|---|---|---|---|---|
| JP | 56-114568 | * | 9/1981 | 72/360 |
| JP | 57-75241 A | | 6/1982 | |
| JP | 0138045 | | 6/1991 | |
| RU | 648318 | | 2/1979 | |
| RU | 869926 | | 10/1981 | |
| RU | 1214300 | | 2/1986 | |
| RU | 1562055 A1 | | 5/1990 | |
| RU | 1572734 A1 | | 6/1990 | |
| RU | 1669630 | | 8/1991 | |

* cited by examiner

*Primary Examiner*—Ed Tolan
(74) *Attorney, Agent, or Firm*—Robert L. Marsh

(57) ABSTRACT

A tool body is cold formed by inserting a blank into a die which defines a portion of the outer surface of the tool body after which a punch applies an impact to the blank causing the outer surface of the blank to conform to the contour defined by the die. The tool body has a tapered forward end, a central radial flange and a rearward cylindrical shank. To cold forge a fixed diameter in the central flange of the tool the forging die has a cylindrical portion having an inner diameter equal to the desired diameter of the flange, the die having an end to allow overfill to be released forward of the fixed diameter portion. Also, a shoulder is formed between the cylindrical shank and a frustoconical portion between the shank and rear surface of the flange. Finally, the shank has an elongate cylindrical hub to facilitate alignment of the tool.

4 Claims, 9 Drawing Sheets

14

TOOL BODY AND METHOD OF MANUFACTURE

The present invention relates to rotatable tool bodies of the type mounted in a machine for cutting hard surfaces and, in particular, an improved method of cold forging such tool bodies.

BACKGROUND OF THE INVENTION

Machines for cutting hard surfaces, such as concrete and asphalt, provide for a rotating wheel or drum with a plurality of cutting tools mounted around the circumference of the wheel or drum such that each tool cuts a small portion of the hard surface, thereby advancing the cut. The tools of such machines are symmetrical around a longitudinal axis and have a hardened cutting tip and a cylindrical mounting portion rotatably retained in a tool mount on the circumference of the wheel or drum such that the tool can rotate about its longitudinal axis. Rotation of the tool within the mounting member causes the tool to wear symmetrically and thereby increasing its useable life. The concrete and asphalt which is cut by such tools, however, is so abrasive that such tools nonetheless often become so worn in a single day's use that they must be replaced. The tools rarely survive two days of use.

To replace the tools of a cutting machine, the worn tool is removed from the tool holder after which a new tool is inserted therein. As many as six hundred replacement tools are required daily for a machine used to scarf the surface of a lane of pavement of highway. It is, therefore, desirable to maximize the useful life of such tools and to provide tools which are easily inserted into the holders thereof to reduce the down time required to replace the tools in the machine.

Existing cutting tools have a tapered forward cutting end with a tungsten carbide tip. Behind the forward cutting end is a radial flange and behind the flange is a cylindrical shank having a diameter sized to fit within the cylindrical bore of the tool holder. Between the shank and the radial flange is a frustoconical portion having a ramp angle of approximately 45° which facilitates the alignment of the tool within the tool holder. The cylindrical shank has an enlarged diameter hub at the distal end thereof and fitted around the shank, between the hub and the frustoconical portion, is a spring loaded sleeve biased to expand radially outwardly so as to bind against the inner surface of the bore in the holder and thereby retain the tool in the holder.

In use, the tool rotates within the spring loaded retaining sleeve around the shank and the rear surface of the radial flange rotates on the forward surface of the tool holder. The rotation of the radial flange of the tool on the forward surface of the tool holder causes the forward surface thereof to become worn away and, over a period of time, an indentation or a counterbore wears in the forward surface of the tool holder, the diameter of which is substantially equal to the outer diameter of the cylindrical radial flange. Over time, the counterbore within the forward end of a tool holder can be as deep as 3/16 of an inch.

When a replacement tool is inserted into the tool holder for which a counterbore has been worn into the forward surface thereof, the outer diameter of the radial flange of the replacement tool must rotatably fit within the inner diameter of the counterbore. If the outer diameter of the flange is equal to or larger than the inner diameter of the counterbore, it will bind against the inner surface of the counterbore and inhibit the rotation of the tool within the tool holder and thereby cause the tool to become prematurely worn. To prevent the outer circumference of such flange from locking within the counterbore in the tool block, it is desirable to provide tools for which the radial flanges thereof all have equal outer diameters. Such tools are presently cold formed using existing technology in which a metal blank is formed into the desired shape. Since the volume of the metal remains constant, cold forming require that the forming die include an opening through which excess metal can be released, and usually the portion having the largest diameter is chosen to receive the excess metal. Existing cold formed tools have an enlarge outer flange diameter which is irregular in shape because that is where excess metal is released. To insure that such radial flanges all have equal outer diameters, it is presently necessary to machine such outer diameters. The machining step, however, is expensive, and it would be desirable to manufacture tool bodies without machining the outer circumference of the flange.

The rotatability of a tool within a tool holder is also reduced by resistance between the cylindrical shank and the spring loaded retaining sleeve. Although the sleeve is designed to be retained between the forward end of the hub and the frustoconical portion of the tool, if the sleeve is not properly positioned within the tool holder the forward end of the sleeve can become wedged against the frustoconical portion of the tool. The sleeve tends to ride up the 45 degree angle of the frustoconical section thereby increasing the friction between the parts.

Friction also occurs between the outer circumference of the hub at the distal end of the shank and the inner wall of the cylindrical bore into which the shank of the tool is fitted. When the tool is used to cut a hard surface, substantial forces are applied perpendicular to the longitudinal axis of the tool, and complimentary forces are applied between the inner surface of the cylindrical bore and the outer circumference of the hub. These transverse forces increase the resistance to rotation of the tool body within the tool holder and wear away the inner surface of the tool holder.

A third source of friction which reduces the rotatability of the tool is friction against the outer wall of the shank as it rotates within the retaining sleeve. As the tool is used, fine particles of hard material work their way under the radial flange and across the forward surface of the tool holder until they fall into the bore of the holder. Some of those particles work their way down the bore of the holder and between the outer wall of the shank and the inner wall of the retaining sleeve. Particles also enter from the rear of the tool holder, between the hub and the bore of the block and work their way between the shank and the retaining sleeve. Eventually the particles between the shank and the retaining sleeve form a paste of grit which binds between the parts and prevents rotation of the tool, and causes premature tool failure.

In my co-pending application, Ser. No. 09/121,726 filed Jul. 24, 1998, I disclosed an improved tool holder which resists wear from the rotation of the tool within the holder by providing a tungsten carbide wear rings in countersinks located in the forward and rearward ends of the bore of the tool holder. As further explained in my co-pending application, the coefficient of friction between the metal of the tool body and the surfaces of the tungsten carbide wear rings is less than the coefficient of friction between a tool body and the metal surfaces of existing tools, thereby facilitating rotation of the tool within the tool holder. Nonetheless, the friction between the outer circumference of the hub at the distal end of a tool body and the accumulation of particles within the parts also inhibits the rotation of the tool.

In view of the foregoing, it is desirable to provide an improved method of manufacturing an axially symmetric tool for use in such tool holders which can be manufactured without requiring the machining of the outer diameters of the radial flange thereof and which will be less susceptible to wear caused by the transverse forces applied to the hubs at the distal end of the shank of the tool. It would also be desirable to provide an improved tool body which will maintain a retaining sleeve around the circumference of the shank thereof without permitting the forward end of the retaining sleeve to engage the frustoconical surface between the shank and the radial flange thereof. Finally, it would be desirable to provide a tool body which would reduce the amount of fine particles between the shank of the tool and the retaining band.

SUMMARY OF THE INVENTION

It is the present custom to cold form the tool bodies which are used in cutting machines for cutting hard surfaces. In this process, a coil of steel wire is cut into a blank, each of which is heated to an appropriate temperature, typically about six hundred degrees Fahrenheit, after which it is subjected to series of cold forming steps. In each of the steps of the manufacturing process, the blank is mechanically inserted into a die which defines a portion of the outer surface of the tool body after which a punch applies an impact to the blank, causing the outer surface of the blank to conform to the contour defined by the die. The blank is moved through a succession of such dies, during the course of which the first end thereof is tapered into a forward cutting end and the second end thereof is constricted into a cylindrical shank. The contouring of the first end into a tapered forward cutting end causes metal from the first end of the blank to be forced towards the center thereof. Similarly, the constriction of the second end into a cylindrical shank also forces excess metal towards the center of the blank. Existing cold forming machines form the radial flange by allowing excess metal moved during the cold forming process to accumulate in a bulge which becomes the flange. The bulge is forged into the flange, and some excess metal remains around the outer circumference of the flange after the tool is forged. It is this excess metal which is removed during the machining operation.

In accordance with the present invention, the die employed to define the rearward surface of the radial flange includes a cylindrical portion having an inner diameter equal to the desired outer diameter of the rearward 3/16 of an inch of the flange. When the blank is fitted into the die and the punch is impacted against the blank, the cylindrical portion of the die will shape the rearward portion of the radial flange into a cylindrical portion of the desired outer diameter with a length of about 3/16 of an inch. Excess metal or overfill is released forward of the cylindrical portion.

The die used to configure the rearward surface of the radial flange also configures a frustoconical portion between the cylindrical shank of the radial flange. In accordance another feature of the present invention, a shoulder is formed between the cylindrical shank and the frustoconical portion to thereby retain the retainer band around the smaller diameter portion of the shank and prevent the forward edge of the sleeve from engaging the ramp surface of the frustoconical portion.

The hub at the distal end of the shank of existing tools is presently cold formed by providing a die defining an enlarged diameter hub and "bumping" the distal end of the shank, causing it to enlarge within the die and thereby form the hub. The "bumping" technique commonly used is suitable for creating a hub having an overall length of no more than 1/4 inch and, therefore, it is customary for the hubs of such tools to have a length of only about 3/16 inch. I have found, however, that where a tool body is made with the hub having a length longer than 1/4 inch, the side loads created by the forces at the forward end of the tool are distributed over a larger surface thereby causing a reduction in the resistance to rotation and a reduction in the wear caused to the inner surface of the cylindrical bore of the tool holders. I have found that a hub having a longer length can be cold formed by providing a suitable die for an elongated hub and providing a punch having a generally conically shaped forward end for impacting against the distal end of the shank. When the conical punch is impacted axially into the distal end of the cylindrical shank, the forward end of the die extends into the metal of the shank. As the conical punch enters the distal end of the shank, radial forces are applied to the metal of the shank surrounding the conical protrusion. These radial forces applied from within the shank cause the metal of the distal end of the shank to fill the cavity of the enlarged die thereby forming an elongated hub.

BRIEF DESCRIPTION OF THE DRAWINGS

A better understanding of the present invention will be had after a reading of the following detailed description taken in conjunction with the following drawings wherein.

DETAILED DESCRIPTION OF THE PREFERRED EMBODIMENT

Figure 1:
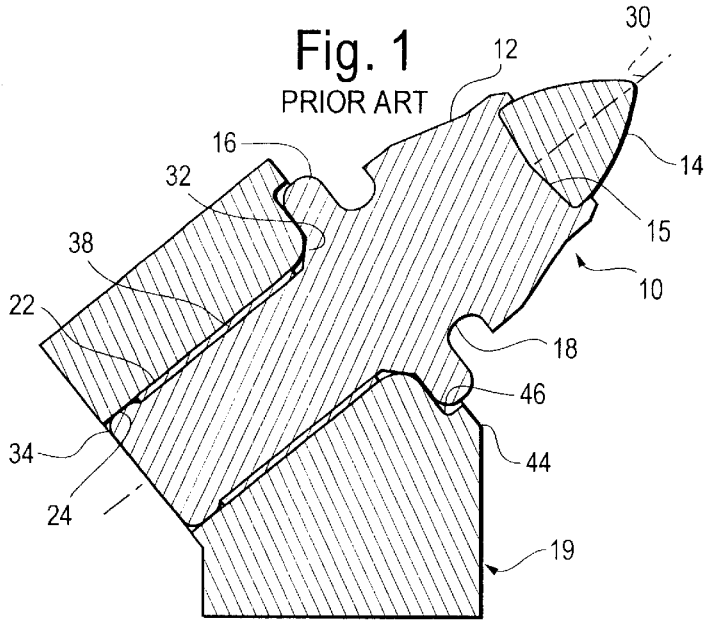
Fig. 1 PRIOR ART
FIG. 1 is a cross sectional view of a tool body manufactured in accordance with the prior art showing the tool retained in a tool holder.
Figure 1A:
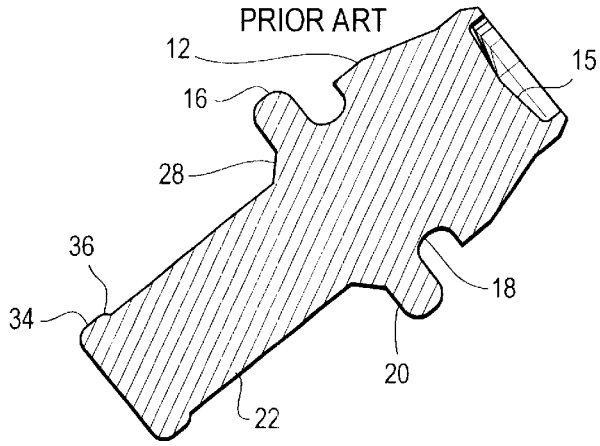
Fig. 1A PRIOR ART
FIG. 1A is a second cross sectional view of the tool body shown in FIG. 1 free of the tool holder and without a tungsten carbide insert.

Referring to FIG. 1 and 1A, a tool 10 in accordance with the prior art has a tapered forward cutting end 12, at the forwardmost end of which is a tungsten carbide cutting tip 14 fitted into a seat 15. Positioned rearward of the cutting end 12 is a radial flange 16 and cut into the outer surface of the cutting end 12 and forward of the flange 16 is an annual groove 18 for receiving the jaws of an extractor tool for retracting the tool 10 from a tool holder 19 on a machine. The rearward surface 20 of the radial flange 16 is planar, and extending rearward from the flange 16 is a cylindrical shank 22 which extends within a cylindrical bore 24 of a tool holder 19. Between the cylindrical shank 22 and the planar rearward surface 20 of the radial flange 16 is a frustoconical portion 28 having an incline of approximately forty-five degrees with respect to the axis 30 of the tool 10. The frustoconical portion 28 provides strength to the union of the shank 22 to the rear surface 20 of the flange 16 and fits within a frustoconical portion 32 of the holder 19 to aid in the alignment of the tool 10 within the tool holder 19. At the distal end of the cylindrical shank 22 is a cylindrical hub 34, the forward end of which defines a shoulder 36.

Fitted around the circumference of the cylindrical shank 22 is a retaining sleeve 38 made of a spring steel, spring loaded to urge the sleeve to expand radially outwardly to compress the outer surface thereof against the inner surface of the cylindrical bore 24 of the tool holder 19. The cylindrical shank 22 of the tool 10 is retained in the bore 24 by the shoulder 36 engaging the rearward edge of the retaining sleeve 38.

To maximize the useful life of the tool 10, it is desirable that the tool 10 rotate round its longitudinal axis 30 with the shank 22 rotating within the retaining sleeve 38 fitted in the cylindrical bore 24. Resistance to rotation of the tool 10 within the sleeve 38 can cause a flat to be worn on the surface of the carbide 14 and cause the tool to become prematurely worn, thereby shortening its useful life. Friction which inhibits rotation occurs between the rearward surface 20 of the radial flange 16 and the forward surface 44 of the mounting block 19, between the outer surface of the shank 22 and the inner surface of the retaining sleeve 38, and between the outer surface of the hub 34 and the inner surface of the cylindrical bore 24.

In the event the retaining sleeve 38 is not fitted entirely within the bore 24, the forward edge of the retaining sleeve 38 can become wedged between the frustoconical portion 28 of the shank 22 and the complimentary frustoconical portion 32 of the tool holder 19 and thereby substantially increase friction and inhibit the rotation of the tool 10. Also, the rotation of the radial flange 16 against the forward surface 44 of the tool holder 19 can wear a counterbore 46 in the forward surface 44. When the tool 10 becomes worn and a new tool 10 is inserted therein having a radial flange 16 with an outer circumference which is larger than the inner circumference of the counterbore 46 the flange 16 the replacement tool 10 will bind against the counterbore 46 and inhibit the rotation of the tool 10. To prevent such binding, the outer circumference of the flange 16 is machined such that all flanges 16 have a common diameter.

Figure 3:
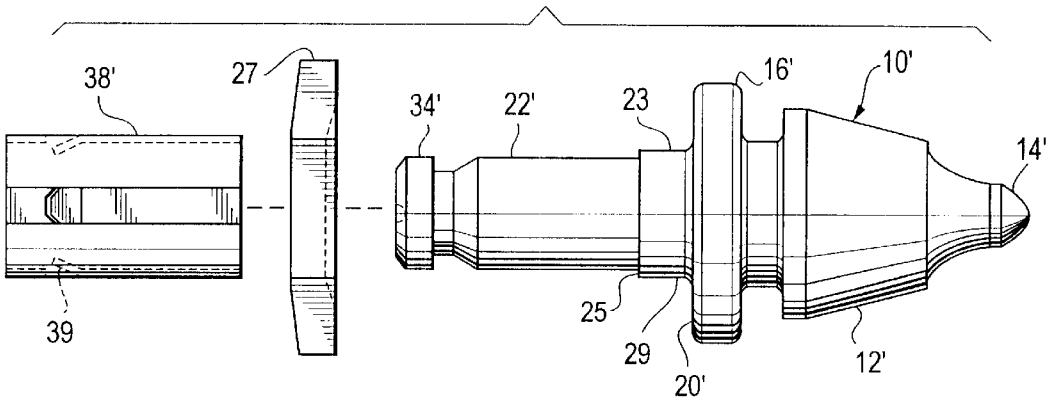
Fig. 3 PRIOR ART
FIG. 3 is an exploded view of a second embodiment of a tool body and a retaining sleeve for retaining the tool in a tool holder in accordance with the prior art.
Figure 3A:
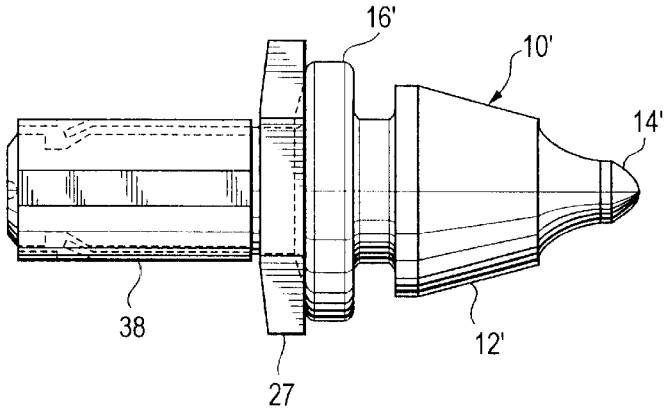
Fig. 3A PRIOR ART
FIG. 3A is an assembled side elevational view of the tool and retaining sleeve shown in FIG. 3.

Referring to FIGS. 3 and 3A, in another embodiment of the prior art a tool 10' has a forward cutting end 12' with a tungsten carbide tip 14'. Rearward of the cutting end 12' is a radial flange 16' and rearward of the flange 16' is a cylindrical shank 22'. In this embodiment the shank 22' has an enlarged diameter forward portion 23 with a shoulder 25 formed between the shank 22' and the forward portion 23. A groove 31 near the distal end of the shank 22' defines a hub 34' having a diameter equal to that of the central portion of the shank 22.'

A spring loaded sleeve 38' having a plurality of detents 39 which engage the groove 31 is fitted around the shank 22' to retain the shank 22' in the bore of a tool holder (not shown). In this embodiment, an annular wear washer 27 is fitted around the forward portion 23 of the shank 22 such that the forward surface thereof abuts the rear surface 20' of the flange 16' and the rear surface of washer 27 rests on the forward surface of the tool holder (not shown).

The washer 27 is replaced each time the tool 10' is replaced. In this embodiment, the flange 16' of the tool 10' rotates on the forward surface of the washer 27 and therefore a counterbore, such as counterbore 46 described with respect to FIG. 1, is not worn into the forward surface of the mounting block. In this embodiment, a small radius 29 is positioned between the forward portion 23 and the rear surface of the flange 16'.

Figure 15:
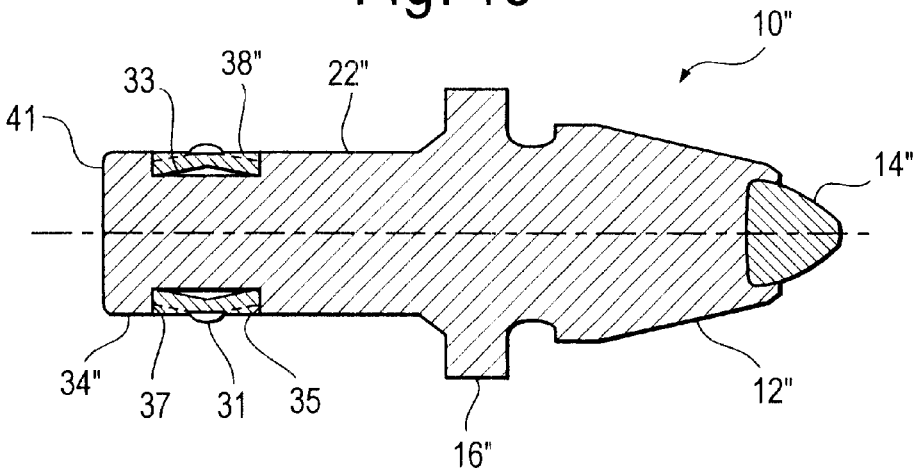
FIG. 15 is a cross sectional view of a third embodiment of a tool body in accordance with the prior art.

Referring to FIG. 15, a third embodiment of a prior art tool 10" is shown in which the parts that are like those of the prior embodiments bear like indicia numbers but are double primed. The tool 10" has a cutting end 12", a tungsten carbide tip 14", a flange 16" and a shank 22". Near the distal end of the shank 22" is an annular groove 33 forming a forward shoulder 35 and a rearward shoulder 37. The distal end 41 of the shank 22" is cylindrical and has an axial length of about 3/16 inch. Fitted around the annular groove 33 is a retainer sleeve 38" which is retained between the shoulders 35, 37. A plurality of protrusions 31—31 on the outer surface of the sleeve 38" engage an undercut in the inner surface of the bore of a tool holder (not shown) to retain the tool 10" in the holder.

Although the tools 10' and 10" served the same purpose as tool 10 and has numerous similarities to tool 10, they offer different solutions to certain problems incurred by such tools. The present invention relates to tools of the type shown in FIG. 1 and 1A as opposed to tool 10' and 10" shown in FIG. 3, 3A, and 14.

Figure 4:
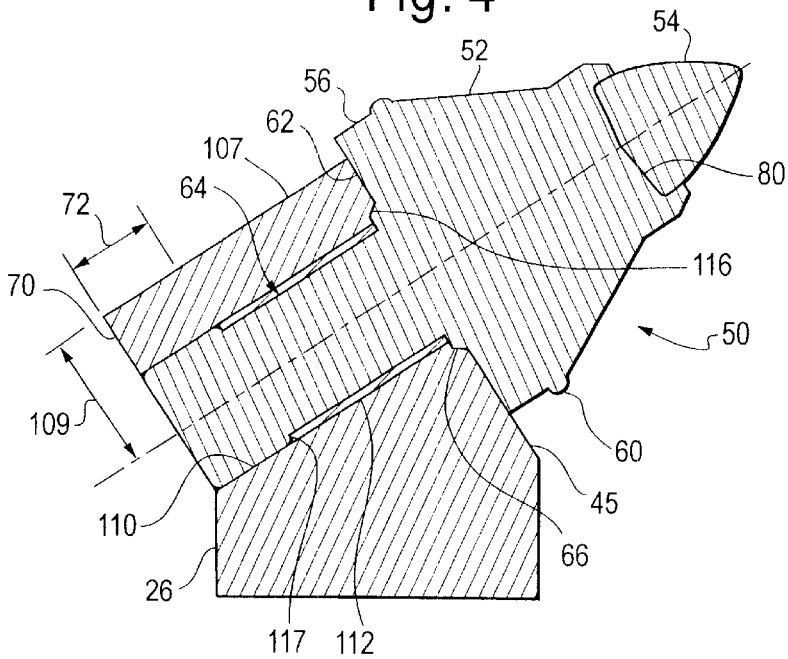
FIG. 4 is a cross sectional view of a tool in accordance with the present invention retained in a tool holder.
Figure 4A:
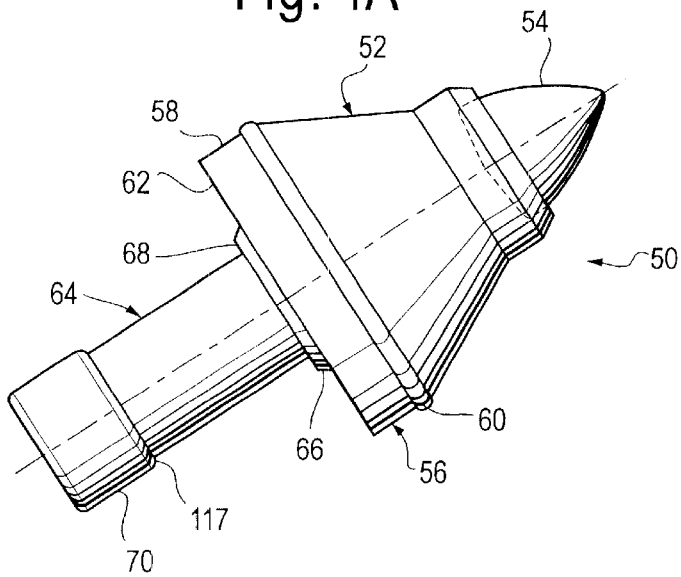
FIG. 4A is a second cross sectional view of the tool body shown in FIG. 4 free of the tool holder and without a tungsten carbide insert.
Figure 5:
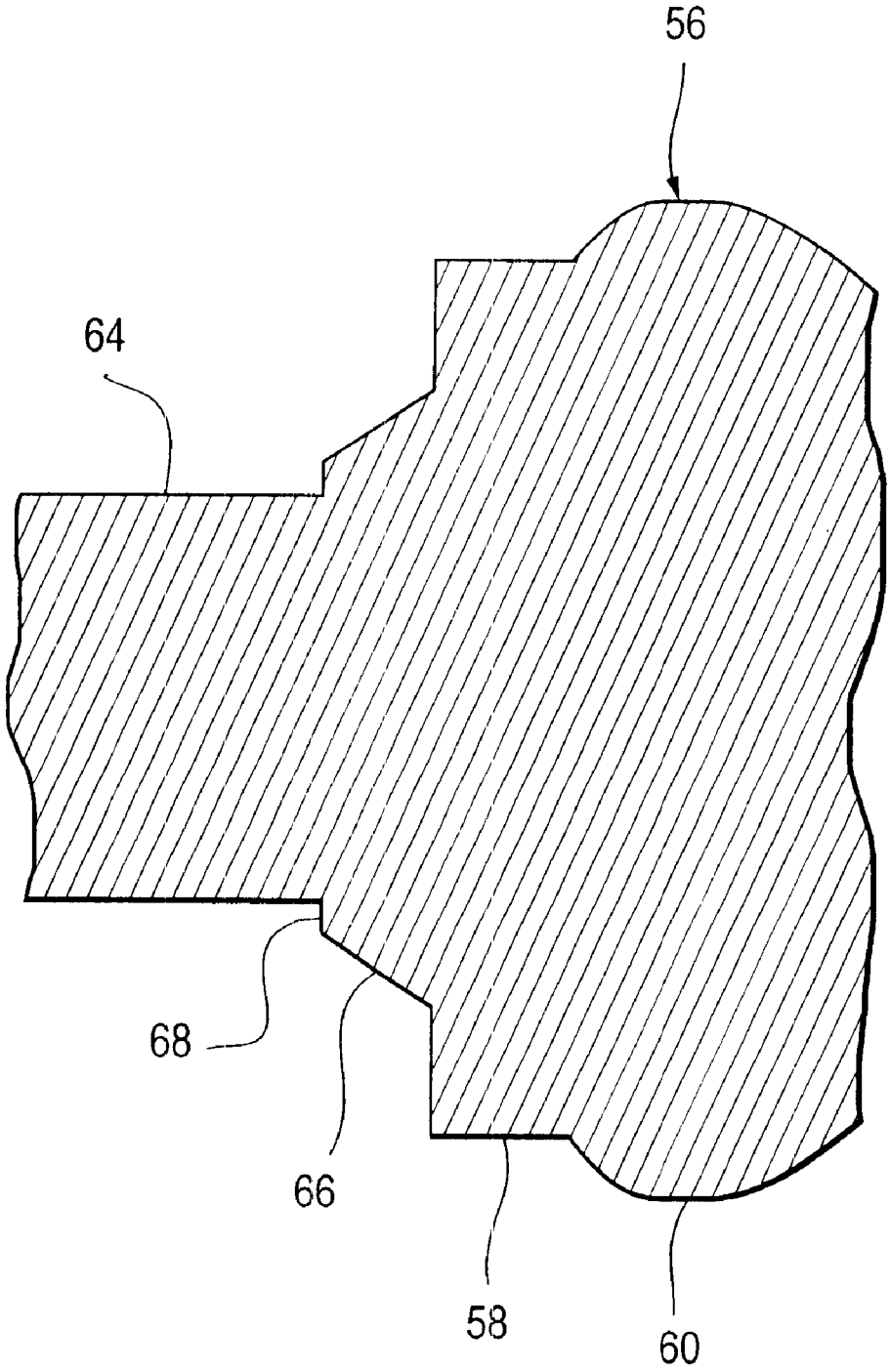
FIG. 5 is a fragmentary enlarged cross sectional view of the tool shown in FIG. 4.

Referring to FIGS. 4, 4A and 5, a tool 50 in accordance with the present invention has a forward cutting end 52 and a tungsten carbide tip 54. Behind the cutting end 52 is a radial flange 56. As further described below, during the course of cold forming the radial flange 56, the rearward portion 58 thereof is constricted in a cylindrical die, having a fixed outer diameter such that the overfill 60 is released forward of the rearward portion 58 of the flange 56 as shown. The rearward surface 62 of the flange 56 is planar and extending rearward of the flange 56 is a cylindrical shank 64. As best shown in FIG. 5, between the cylindrical shank 64 and the planar rear surface 62 of the flange 56 is a frustoconical portion 66, and between the frustoconical portion 66 and the shank 64 is a shoulder 68. Referring further to FIG. 4, at the distal end of the cylindrical shank 64 is a cylindrical hub 70 having an overall length 72 of about ½ inch.

Figure 6A:
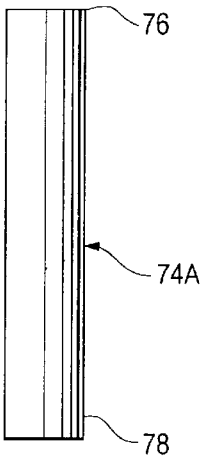
FIG. 6A is a side elevational view of a cylindrical blank that has been cut to size in the first station of a cold forming machine.
Figure 6B:
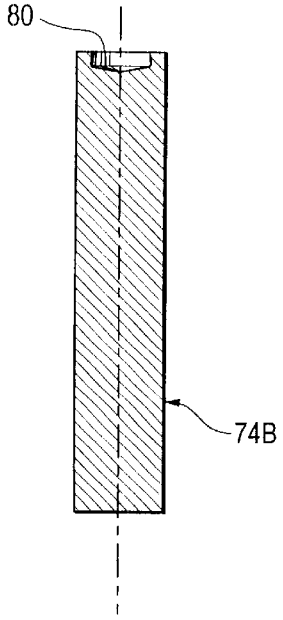
FIG. 6B is a cross sectional view of the blank of FIG. 6A after it has been formed in the second station of the cold forming machine.
Figure 6C:
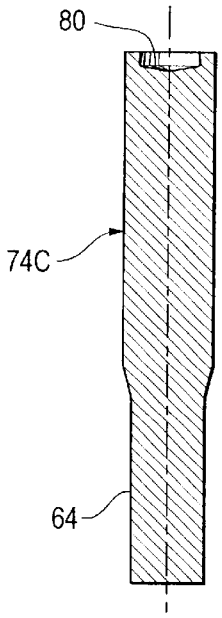
FIG. 6C is a cross sectional view of the blank of FIG. 6B after it has been formed in the third station of the machine.
Figure 6D:
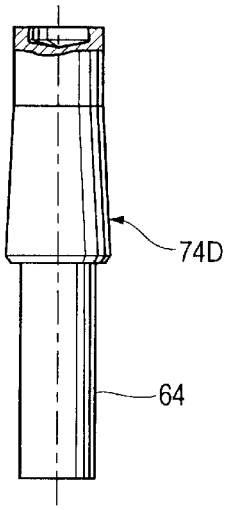
FIG. 6D is a side elevational view taken partially in cross section of the blank of FIG. 6C after it has been formed in the fourth station of the machine.

Referring to FIGS. 6A–6F, the tool 50 is manufactured from a blank 74 consisting of length of steel having a specific diameter shown in FIG. 6A which is subjected to a series of cold forming steps to shape the first end 76 into a tapered forward end 52 and to shape the second end 78 into a cylindrical shank 64 as shown in FIG. 4. The process is carried out in a cold forming machine which is capable of subjecting a metal blank through a number of forming stages, or stations. In each of the forming stages the blank is placed into a die which defines the outer shape to be imparted to the blank, after which the blank is stricken with a punch. When the punch strikes the blank, the metal of the blank is forced against the boundaries of the die thereby altering its shape. FIGS. 6A to 6F depict the changes imparted to the blank 74 (the evolution of the blank being shown as 74A–74F) as it moves through the six stages of a six stage cold forming machine.

Referring to FIG. 6A, in the first stage a piece of cylindrical stock is sheared to the desired length to form the blank 74A. In the second stage, shown in FIG. 6B, a seat 80 is punched into the first end 76 to form blank 74B. In the third stage, shown in FIG. 6C, the second end 78 is constructed to form the shank 64 of blank 74C. In the forth stage, shown in FIG. 6D, the forward end of blank 74D is partially formed. In the fifth stage, shown in FIG. 6E, the balance of the forward cutting end 52 and the flange 56 are formed in blank 74E, and in the sixth stage, shown in FIG. 6F, the hub 70 is formed to complete the tool body 50.

Figure 2:
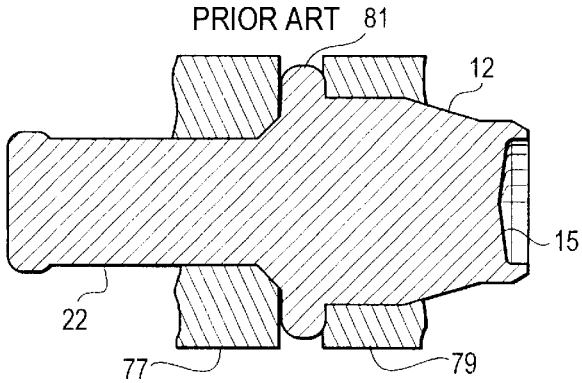
Fig. 2 PRIOR ART
FIG. 2 is a fragmentary cross sectional view of the punch and die required to form the radial flange of a prior art tool body such as shown in FIGS. 1 and 2.

Referring to FIG. 2, the flange 16 of a prior art tool body 10 is formed by first moving excess metal into the proximity of the flange 16 and then applying dies 77, 79 to the forward and rearward surfaces thereof to give those surfaces the desired shape. A bulge 81 of excess metal accumulates between the two dies 77, 79 and it is this bulge 81 that is subsequently machined to form the cylindrical outer circumference of the flange 16.

Figure 6E:
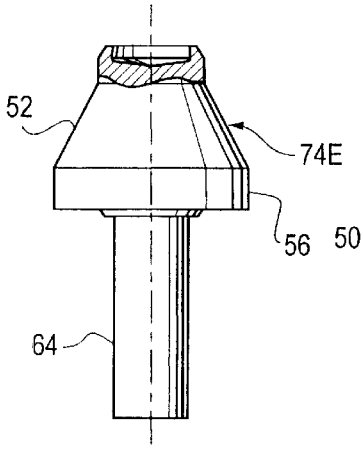
FIG. 6E is a side elevational view taken partially in cross section of the blank shown in FIG. 6D after it has been formed in the fifth station of the machine.
Figure 6F:
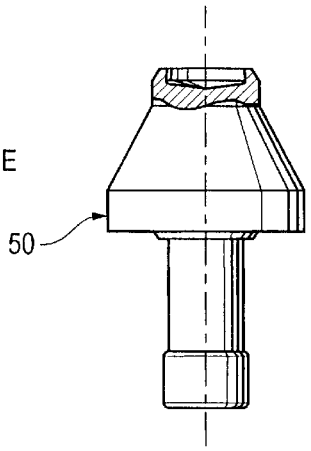
FIG. 6F is a side elevational view of the finished tool body after being formed in the sixth station of the machine.
Figure 7:
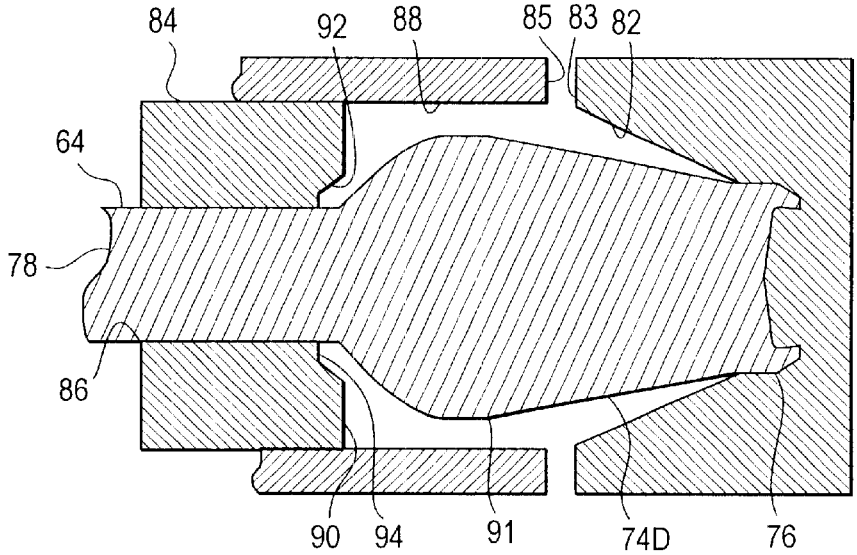
FIG. 7 is a cross section view with the forward end in cross section of a punch and a first and second die suitable for forming a radial flange in accordance with the present invention fitted around a partially formed blank of a tool body before the punch is impacted against a blank.
Figure 8:
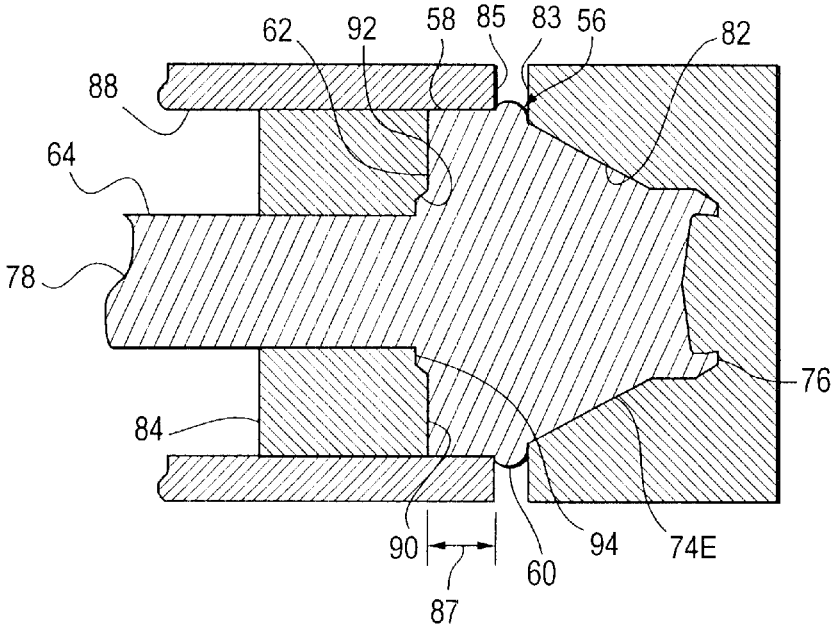
FIG. 8 is a cross sectional view of the punch and dies shown in FIG. 7 after the punch is impacted against a blank.

Referring to FIGS. 7 and 8, in accordance with the present invention, the fifth stage of the cold forming operation (the results of which are shown in FIG. 6E) there is a first die 82, having an inner surface shaped complimentary to the outer surface of the forward cutting end 52 of the completed body of the tool 50 into which the forward first end 76 is fitted as shown. A punch 84 has a cylindrical central opening 86 sized to receive the cylindrical shank 64 already formed at the second end 78 of the blank 74E. The punch 84 moves within a second die 88 having a cylindrical inner surface for forming the cylindrical rearward portion 58 (best shown in FIG. 4A) of the radial flange 56. The punch 84 has an annular planar surface 90 complimentary to the planar rearward surface 62 ( shown in FIG. 4A) of tool 50, and rearward of the planar surface 90 is a frustoconical surface 92 for shaping the frustoconical portion 66 (shown in FIG. 4A) of the tool 50. Between the frustoconical surface 92 and the cylindrical central opening 86 is an annular planar portion 94 complimentary in shape to the shoulder 68 (also best shown in FIG. 4A). The first die 82 has a rearward surface 83 and the second die 88 has a forward surface 85 spaced a short distance from the rearward surface 83 of the first die 82 as shown.

When the punch 84 is struck against the rearward surface of the partially formed central portion 91 (FIG. 7) of blank 74D, it is shaped complimentary to the inner surface of the punch 84 and first and second dies 82, 88. After contacting the blank 74D, the punch 84 continues to move through the cylindrical die 88 until the parts have reached the configuration shown in FIG. 8. The punch 84 has a circumferencial edge which, at the end of the stroke of the punch, is spaced a distance 87 from the end 85 of the second die 88. In the preferred embodiment distance 87 is about 3⁄16 inch. As can be seen in FIG. 8, after the punch 84 is struck against the partially formed central portion 91 of the blank excess metal or overfill 60 is released between the ends 83, 85 of the first and second dies 82, 88. Upon removal of the dies 82, 88 the bar stock 74E will be formed into the shape of the body of the tool 50, except for the formation of the hub 70 as shown in FIG. 6E.

The punch 84 and second die 88 are configured to form the cylindrical rearward portion 58 of the flange 56 (best shown in FIG. 5) with an axial length of about 3⁄16 inch. This portion of the flange is formed with a diameter which will fit within the counterbore 46 (shown in FIG. 1) worn into the tool holder 19 without requiring expensive machining. Since the counterbore 46 does not wear deeper than 3⁄16 inch, the overfill 60 will not interfere with the rotation of the tool 50, and does not have to be machined away.

Figure 13:
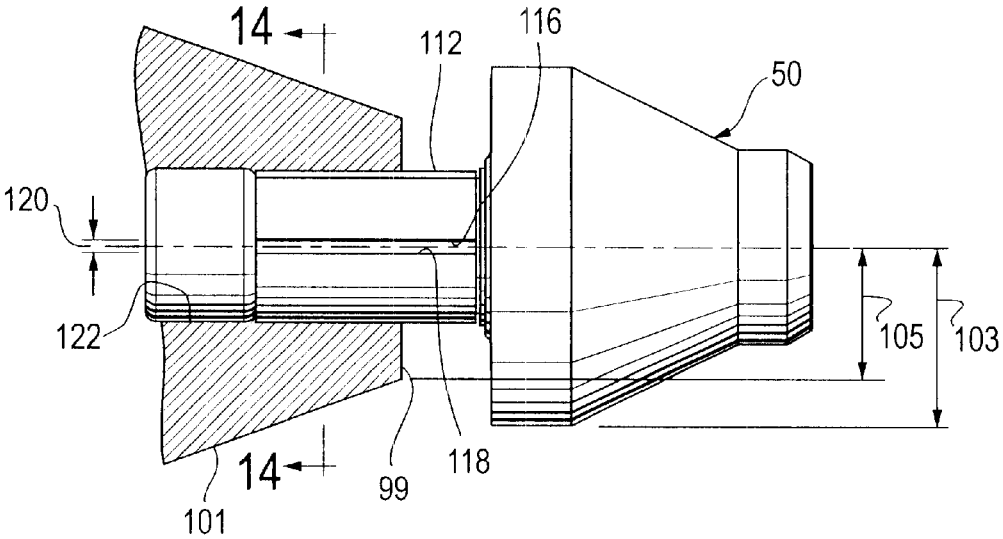
FIG. 13 is a fragmentary cross sectional view of the tool mounting having a tool and the retaining sleeve shown in FIG. 12 partially inserted into the mounting block.

Referring to FIGS. 4 and 13, the forward surfaces 45, 99 of existing tool holders 26, 101 have either a circular peripheral edge (forward surface 99 of tool holder 101 has a circular peripheral edge with a radius 105) or an arcuate portion of the peripheral edge (forward surface 45 has an arcuate portion at 107 with a radius 109). In accordance with another feature of the invention the cylindrical portion 58 of the radial flange 56 has a radius 103 that is larger than the radius 109 of accurate portion 107 or larger than that of radius 105 of circular forward surface 99. The tool body 50 can be easily removed from the associated tool holder 26, 101 using a hammer and a chisel to strike the portion of the radial flange 56 which extends beyond the radius 105, 109 of the tool holder 26, 101. The tool 50 having an enlarged diameter flange as described can be removed from a tool holder 26, 101 without using an extractor groove, thereby saving the cost of machining the extractor grove.

Figure 9:
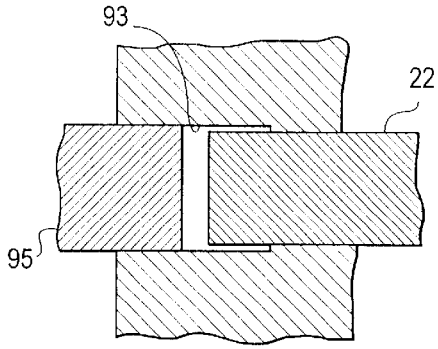
Fig. 9 PRIOR ART
FIG. 9 is a cross sectional view of the punch and die for forming an elongate hub positioned at the distal end of a shank of a partially formed tool body in accordance with the prior art.

Referring to FIGS. 1 and 9, the hub 34 of prior art tools 10 are formed by fitting the distal end of the shank 22 in a die 93 having an inner surface complimentary to the desired shape of the hub 34, then "bumping" the distal end with a punch 95 to expand the distal end of the shank 22 into the contour of die 93.

Figure 10:
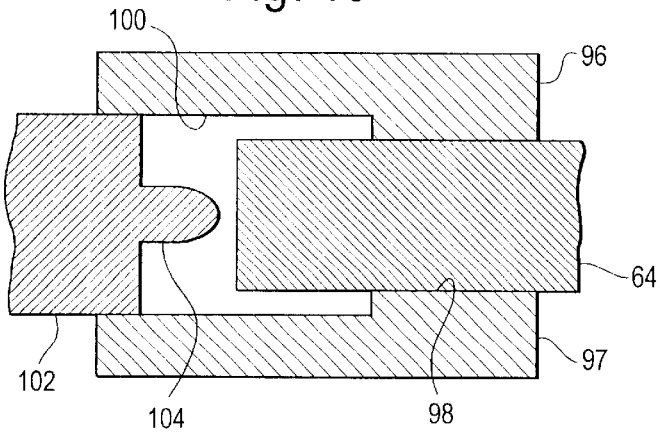
FIG. 10 is a cross sectional view of the punch and die for forming an elongated hub at the distal end of a shank in accordance with the present invention.

Referring to FIG. 10, to form the hub 70 of the present invention, a die formed of a plurality of segments, two of which 96, 97 are visible, has a forward central opening 98 sized to slideably fit over the distal end of the cylindrical shank 64 and a larger rearward cylindrical portion 100 positioned axially behind the forward central opening 98. A generally cylindrical punch 102, the outer diameter of which is not larger than the inner diameter of the rearward central portion 100 of the die 96, 97 has an axially positioned conical protrusion 104 therein.

Figure 11:
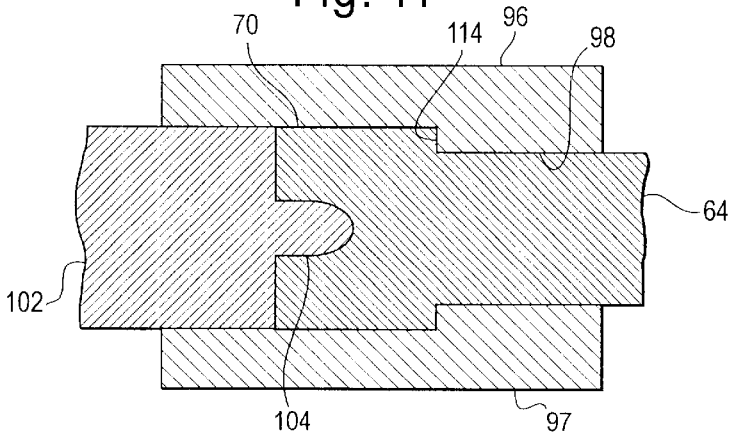
FIG. 11 is a cross sectional view of the punch and die shown in FIG. 10 after the punch has been struck.

Referring to FIG. 11, after the punch 102 has been struck against the distal end of the cylindrical shank 64, the impact of the punch 102 forces the conical protrusion 104 into the distal end of the shank 64 and causes the metal of the shank to be expanded into the second cylindrical opening 100 of the die 96, 97 as shown. Thereafter, the segments 96, 97 of the first die can be removed from around the shank 64 to leave a hub 70 having an extended length.

Referring to FIGS. 4 and 4A, when the tool 50 is inserted into a tool holder 26, the tool 50 will be retained within the bore 110 of the tool holder 26 by a sleeve 112 made of a spring steel similar to the sleeve 38 of the prior art, but having a somewhat shorter axially length. To compensate for the shorter length, the steel from which the sleeve 112 is made, is ten percent to fifteen percent thicker than the sleeve 38 of the prior art. A shoulder 117 between the hub 70 and the cylindrical shank 64 will engage the rearward edge of the sleeve 112 and thereby retain the tool 50 within the tool holder 26 as was the case in the prior art. The forward end of the sleeve 112 cannot, however, become wedged between the frustoconical portion 66 of the tool 50 and the complimentary frustoconical portion 116 of the holder 26, but will instead contact the shoulder 68 (best seen in FIGS. 4A and 5) and therefore will not inhibit rotation of the tool 50 within the block 26 as can occur with the tool 10 in the prior art.

As explained above, the hub 70 of the tool 50 has a longer length than the hub 34 of the prior art tool 10 and preferably has a length of ½ inch. One benefit of this configuration is that the longer length of the hub 70 facilitates the aligning of the tool 50 when the shank 64 is inserted into the bore 110 of the tool holder 26 and thereby facilitates the replacement of a tool into the tool holder 26. Referring to FIGS. 1 and 1A, prior art tools, having a hub 34 with a shorter length, have been found to become easily misaligned with respect to the bore 24 during the insertion thereof into a tool holder. When the forward cutting end 12 of the tool 10 is thereafter struck with a hammer to insert the tool therein, the misaligned tool causes damage to the inner surface of the bore 24.

Referring to FIG. 4, in addition to facilitating the alignment of the tool 50 in the bore of the tool holder 26, the extended length of the hub 70 provides a greater surface area of the hub 70 to engage the inner surface of the bore 110 and thereby reduced the friction between the surfaces and reducing the rate at which the inner surface of the bore 110 becomes worn.

Figure 12:
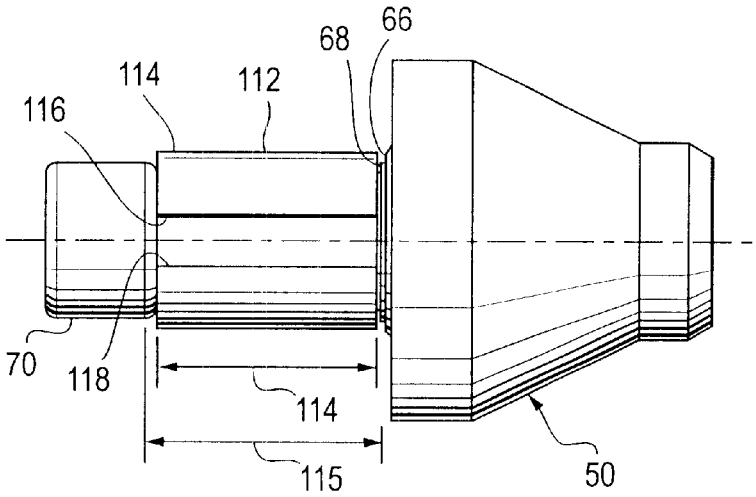
FIG. 12 is a side elevational view of a tool body in accordance with the invention having a sleeve fitted around the shank thereof.

Referring to FIGS. 4, 12 and 13 in accordance with another feature of the present invention the sleeve 112 has a length 114 which is about 1/16 inch shorter than the distance 115 between the shoulder 117 formed by the hub 70 and the shoulder 68 adjacent to the frustoconical section 66. The presence of the shoulder 68 allows the close tolerances as set forth above, and those tolerances prevent most of the fine particles loosened by the tool 50 in the cutting process from working between the inner surface of the sleeve 112 and the shank 64. It has similarly been found that sizing the width of the sleeve 112 so that the ends 116, 118 thereof are spaced a distance 120 of no more than 0.030 inch apart when the sleeve 112 is fitted into the bore 122 of the tool holder 101.

Prior art 10, 10' have hubs 34, 34' with diameters which are a little less than the diameter of the bore 24 of the tool holder 19 in which it is fitted The diameter of the shank 22, 22', on the other hand, is significantly smaller than that of the bore 24. The hub 34, 34' of such prior art tools, therefore, facilitates the centering of the shank 22, 22' within the sleeve 38, 38' and acts as a bearing to facilitate rotation of the tool 10, 10'. One standard size diameter for the bore of a tool holder is 0.783±0.0025 inch, and a standard diameter of a hub for a tool 10, 10' received in that bore is 0.765±0.005 inch, allowing 0.009 inch spacing between the outer surface of the hub 34, 34' and the inner surface of the bore 24.

Figure 14:
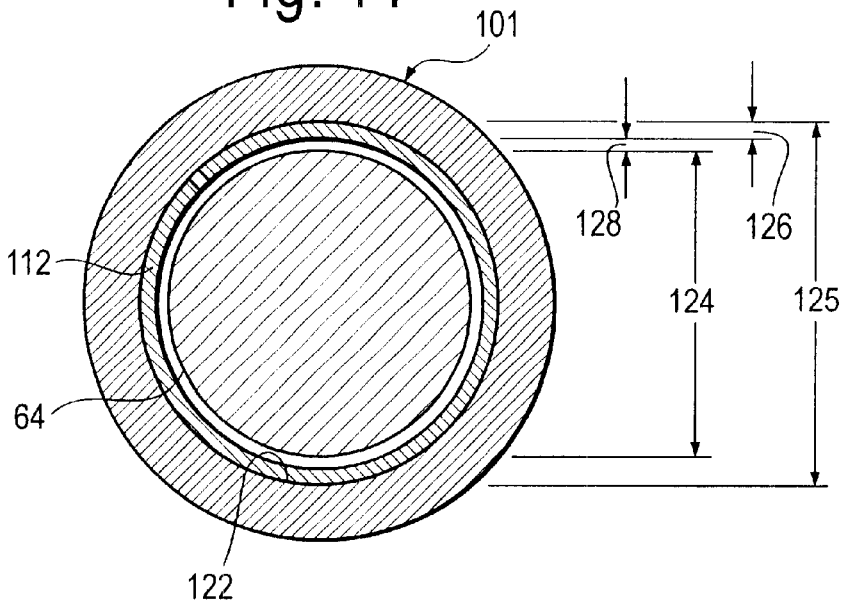
FIG. 14 is an enlarged cross sectional view of the tool mounting and tool shown In FIG. 13 taken through line 14—14 thereof.

Referring to FIG. 14, in the preferred embodiment the shank 64 of the tool 50 has a diameter 124 sized for closer tolerances between the corresponding parts of the prior art. A tool 50 sized to fit within a 0.765 bore 125 will have a shank 64 diameter of 0.672±0.005 inch. As previously stated, the sleeve 112 is made of a thicker gauge of steel to compensate for its shorter length, and for tools sized to fit in a 0.783 inch diameter bore, the sleeve 112 has a thickness 126 of 0.045 inch. As a result the spacing 128 between the outer surface of the shank 64 and the inner surface of the sleeve 112 is 0.010 inch. The spacing between the shank 64 and the sleeve 112 is approximately the same as the spacing between the outer surface of the hub 70 and the inner surface of the bore 122. Unlike prior art tools 10, 10', the shank 64 of the tool 50 therefore also acts as a bearing surface to facilitate rotation of the tool 50 within the bore 112 of the tool holder 26, 101.

For the purposes of this discussion it should be appreciated that the term "tool holder" applies to any form of a cutting tool holder and is not limited to a block as depicted in many of the drawings. Specifically, the term "toll holder" includes a cutting tool holder which may be a single block or a replaceable tool holding structure which is retained in a block on a machine.

While the present invention has been described with respect to a single embodiment, it will be appreciated that many modifications and variations can be made without departing from the true spirit and scope of the invention. It is, therefore, the intent of the following claims to cover all such variations and modifications which come within the true spirit and scope of the invention.

What is claimed:

1. The method of forging a cutting tool body having a longitudinal axis and a contoured surface including a cylindrical mounting shank and having an enlarged diameter cylindrical hub at the distal end thereof, said hub having an axial length sufficient to align said tool within a cylindrical bore of a tool holder, said method comprising providing a blank of bar stock having an end, forming said end of said bar stock into a cylindrical shank having a distal end, providing a die made of a plurality of segments having a first portion complimentary in shape to said cylindrical hub and having a coaxial cylindrical second portion with a diameter equal to said diameter of said shank, assembling said die around said distal end of said shank, providing a punch having a forward end and a protrusion at said forward end of said punch, positioning said punch at said distal end of said shank, impacting said punch against said distal end to drive said protrusion into said distal end of said shank and thereby expand said shank into said die to form said hub, and removing said die from said shank.

2. The method of claim 1 wherein said shank has an indentation therein for receiving said protrusion of said punch when said punch is impacted against said distal end of said shank.

3. The method of claim 1 and comprising the further steps of providing a die and a punch for forming a radial flange, said radial flange having a cylindrical portion of a given diameter, and overfill released forward of said cylindrical portion.

4. The method of claim 3 and further comprising the steps of providing a die and a punch for forming a frustoconical portion between said radial flange and said shank, and for forming a shoulder between said shank and said frustoconical portion.

* * * * *